US007370923B2

(12) United States Patent
Tanno et al.

(10) Patent No.: US 7,370,923 B2
(45) Date of Patent: May 13, 2008

(54) INKJET PRINTER

(75) Inventors: Ryuji Tanno, Hachioji (JP); Koji Matsushima, Akishima (JP)

(73) Assignee: Konica Minolta Medical & Graphic, Inc. (JP)

( * ) Notice: Subject to any disclaimer, the term of this patent is extended or adjusted under 35 U.S.C. 154(b) by 271 days.

(21) Appl. No.: 11/171,697

(22) Filed: Jun. 29, 2005

(65) Prior Publication Data

US 2006/0007254 A1 Jan. 12, 2006

(30) Foreign Application Priority Data

Jul. 7, 2004 (JP) ..... 2004-200338
Jul. 7, 2004 (JP) ..... 2004-200363

(51) Int. Cl.
*B41J 2/195* (2006.01)

(52) U.S. Cl. ..... 347/7; 347/84; 347/85; 347/6

(58) Field of Classification Search ..... 347/7
See application file for complete search history.

(56) References Cited

U.S. PATENT DOCUMENTS 4,652,222 A * 3/1987 Aiba ..... 417/540
5,479,968 A * 1/1996 Sanchez et al. ..... 141/110
6,796,627 B2 * 9/2004 Kimura et al. ..... 347/7
6,866,355 B2 * 3/2005 Aruga et al. ..... 347/7
6,918,642 B2 * 7/2005 Horigome ..... 347/5
6,991,680 B2 * 1/2006 Kojima ..... 118/302
7,040,729 B2 * 5/2006 Richards ..... 347/7
7,070,255 B2 * 7/2006 Nakajima ..... 347/29
2003/0210309 A1 11/2003 Hitotoshi et al.

FOREIGN PATENT DOCUMENTS

JP 04-185352 7/1992

* cited by examiner

*Primary Examiner*—Matthew Luu
*Assistant Examiner*—Brian J. Goldberg
(74) *Attorney, Agent, or Firm*—Squire, Sanders & Dempsey L.L.P.

(57) ABSTRACT

Installed are intermediate tank 12 with damping function against pressure fluctuation for temporarily storing ink in a position within ink supplying pipe 9*a* which supplies ink from main tank 11 to recording head 7, liquid supplying pump 23 between main tank 11 and intermediate tank 12 for supplying ink to intermediate tank 12 and controller 25 actuating liquid supplying pump 23 to supply ink from main tank 11 to intermediate tank 12 when membrane surface detecting sensor 19 detects that the quantity of remaining ink in intermediate tank 12 is less than a prescribed one. When liquid supplying pump is actuated and no increase of quantity of remaining ink in intermediate tank 12 is detected, controller 25 judges that that there is no remaining ink in main tank 11 and a result of the judgment is notified by display section 28.

13 Claims, 5 Drawing Sheets

FIG. 2 ( a )
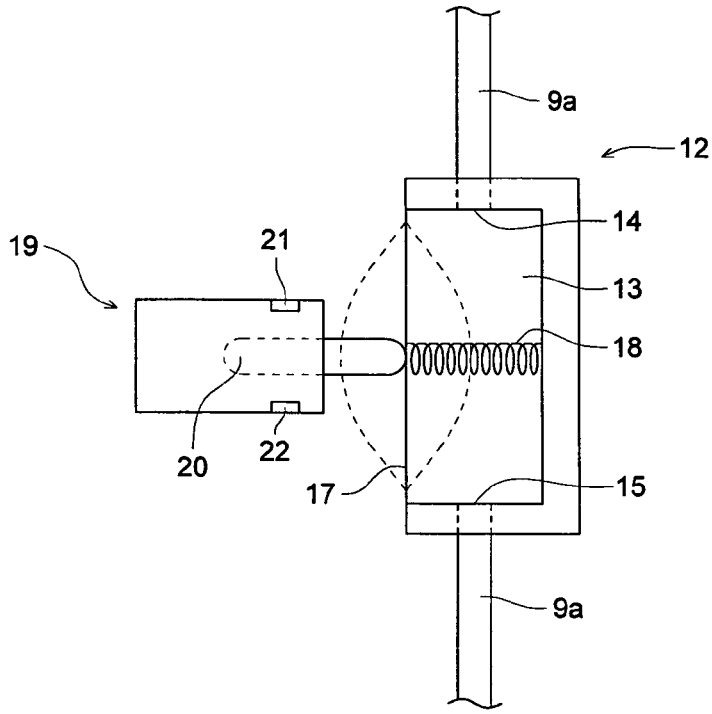
FIG. 2 ( b )
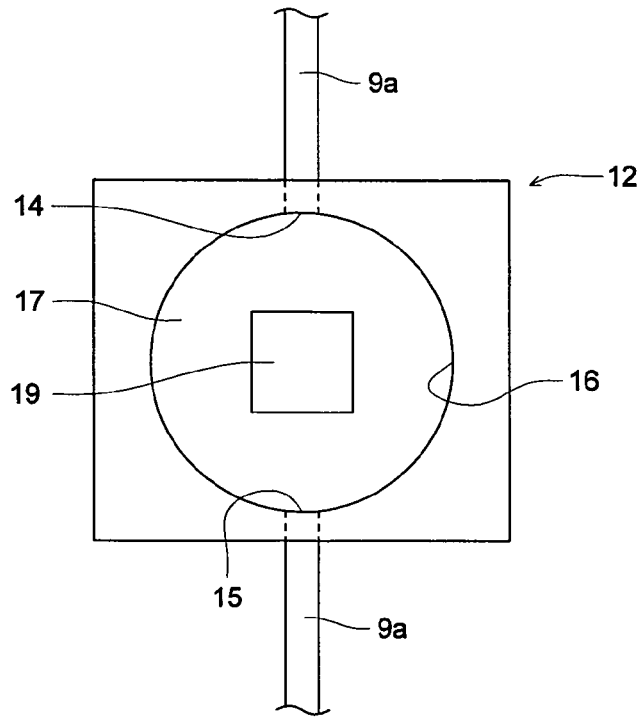

INKJET PRINTER

This application is based on Japanese Patent Application Nos. 2004-200338 and 2004-200363 filed on Jul. 7, 2004 in Japanese Patent Office, the entire content of which is hereby incorporated by reference.

BACKGROUND OF THE INVENTION

The present invention relates to an inkjet printer and in particular to an inkjet printer for performing image recording using high viscosity ink.

Inkjet printers are generally known as a means to perform printing on various recording media. Inkjet printer refers to a printer in which image recording on a recording medium is performed when ink in the form of small droplets is emitted from the nozzle of the recording head, using a piezoelectric element or a heater for example onto a recording medium such as paper or the like, and the recording head is moved over the recording medium while the ink penetrates or is fixed on the recording medium. Inkjet printers have the advantage that printing on demand is possible since a plate-making process is unnecessary. In particular, ink jet printers using photo-curing type ink which is cured by light such as ultraviolet light have become known in recent years, and with this type of inkjet printer, light is irradiated on the ink which has been deposited on the recording medium to thereby be cured and fixed on the recording medium. As a result, it is possible for printing to be easily performed on recording media which do not absorb ink such as transparent or semi-transparent resin films and the like.

In such an inkjet printer, when high viscosity ink is employed for image recording, pressure loss is caused in the ink supplying pipe because of frictional resistance. As a result, in the case of sequential jetting of ink from the recording head nozzle, ink cannot be led to the nozzle only by the jetting force and a jetting defect may be caused. As means to prevent the jetting defect of ink caused by the pressure loss, means to reduce influence of pressure loss by providing a sub-tank for supplying ink to recording head to shorten the distance between the sub-tank and recording head and further providing a back pressure controlling pump to control the back pressure is known, as well as means to reduce frictional resistance in the ink supplying pipe by employing a larger diameter or a shorter length for the ink supplying pipe (for example, Patent Document 1).

When the ink to be used is high viscosity one, it is preferable that the diameter of the ink supplying pipe is 7 mm or larger and for example the length of it is 1 meter or shorter. However, there is a problem that it is difficult to realize this situation regarding the diameter or length of the ink supply pipe by reason of the designing difficulty of inkjet printer.

In the case of installation of a sub-tank by the recording head or a back pressure controlling pump, the structure of the inkjet printer becomes complicated. Especially, to position sub-tanks near the recording head, sub-tanks the number of which is corresponding to that of recording head needed to be mounted on the carriage and it causes upsizing and weight increase of carriage and further causes upsizing and weight increase of the apparatus itself. Furthermore, reinforcement of the driving system to drive such a large carriage is needed and there is a problem that it increases the apparatus cost.

Further, in this type of inkjet printer, image recording generally is performed while supplying ink as needed, to the recording head from the tank for storing the ink, but the quantity of ink that is stored in the ink tank decreases as image recording operations are repeated. Thus, in order to perform the image recording operation smoothly and continuously, it is necessary to accurately determine the quantity of ink remaining in the ink tank, and to replenish the ink when there is no remaining ink.

As a result, a method was carried out in which a weight sensor provided in the ink tank, detects the quantity of remaining ink by determining the change in weight of the ink tank. Alternatively a method was performed in which the quantity of ink remaining in the ink tank was calculated by keeping count of the quantity of ink which is jetted during image recording, and subtracting the counted ink quantity from the total ink quantity in the ink tank (for example Patent Document 2).

[Patent Document 1] Patent No. 2934016

[Patent Document 2] Tokkaihei No. 9-248917

However, the ink tank has various parts such an outer ink casing, joint members and the like. As a result, in the method providing a weight sensor in the ink tank, when an attempt is made to detect the weight of the ink inside the ink tank, the weight of these parts is also measured along with the weight of the ink in the tank, and this caused a problem in that weight measurement could not be performed with high accuracy. Further, there were also sometimes jetting abnormalities due to missing nozzles and the like, or ink would be forcibly absorbed from the nozzle at the time of cleaning the recording head, or sometimes there would be ink outflow as a result of air jetting. However, the method of counting the quantity of ink ejected during image recording does not count this type of ink outflow, and in addition, because high accuracy management of the ink outflow due to jetting abnormalities and ink outflow at the time of cleaning is difficult, there was a problem in that the quantity of ink remaining could not be accurately determined.

SUMMARY OF THE INVENTION

The present invention was devised in view of solving the above-described problems, and the object thereof is to provide an ink jet printer which can reduce pressure loss of ink to ensure stable image recording by a simple structure and can easily and suitably detect when there is no ink remaining in the ink tank and accurately determine the time for replenishing the ink tank with ink.

In order to solve these problems, the present invention is characterized by including an ink tank for storing the ink, a recording head for jetting the ink, an ink supply pipe for supplying the ink from the ink tank to the recording head, an intermediate tank with damping function against pressure fluctuation for temporarily storing ink on the path of the ink supply pipe and a liquid feeding pump which pumps ink to the intermediate tank at a point between the ink tank and the intermediate tank, a remaining quantity detector for detecting the quantity of ink remaining in the intermediate tank, a notifying section for providing notification when there is no ink remaining in the ink tank; and a controller for controlling the liquid feeding pump which feeds ink inside the ink tank to the intermediate tank when the remaining quantity detector detects that the quantity of ink remaining in the tank is less than a prescribed quantity and the controller determines that there is no ink remaining in the tank, when the remaining quantity detector does not detect an increase in the quantity of ink remaining in the intermediate tank, even when the liquid feeding pump is operated and this information is relayed by the notifying section.

In this manner, in the present invention having this type of configuration, the remaining quantity detector detects the quantity of ink remaining in the intermediate tank provided on the path of the ink supply pipe, and in the case where the remaining ink quantity is less than a prescribed quantity, the controller controls the liquid feeding pump to pump the ink in the ink tank into the intermediate tank. In addition, when the remaining quantity detector does not detect an increase in the quantity of ink remaining in the intermediate tank even when the liquid feeding pump is operated, the notifying section relays the information that there is no ink remaining in the ink tank.

The present invention is the inkjet printer, wherein the intermediate tank includes a chamber for storing ink, and at least one surface of the ink chamber has a flexible damper membrane and an elastic member which maintains the damper membrane in a prescribed initial position.

In the present invention which has this type of configuration, pressure variations in the ink due to the inflow and outflow of ink are absorbed by bending the damper membrane which is provided at one surface of the ink chamber in the intermediate tank and the damper membrane is held at a prescribed initial position due to the elastic member and the chamber is kept in a negative pressure state.

The present invention is the inkjet printer, wherein the remaining quantity detector is a photo-sensor for detecting the position of the damper membrane or a pressured sensor for detecting the pressure of the ink that flows out from the intermediate tank.

The present invention which has this type of configuration detects whether the prescribed quantity of ink remains in the intermediate tank using the photo-sensor or the pressure sensor.

The present invention is the inkjet printer, wherein the recording head heats the ink which is a liquid having a viscosity of 10-500 mpa·s at a temperature of 30° C., to 30-150° C. using a heater, and the ink is jetted to be small droplets such that one dot is 2-20 pl.

The present invention having this type of configuration performs image recording using high viscosity ink with a viscosity of 10-500 mpa·s at 30° C.

The present invention is the inkjet printer, wherein the ink is the photo-curing type ink which is photo-cured by the irradiation of light, and a light irradiating device is provided for irradiating light on the ink which is deposited on the recording medium downstream than the recording head in the conveying direction of the recording medium.

Thus, in the present invention, by irradiating light on the ink which is jetted from the recording head, ink is cured and fixed on the recording medium.

The present invention is for the inkjet printer, wherein the ink is the ultraviolet light curing type ink which is cured by the irradiation of ultraviolet light, and at least a part of the light irradiated from the light irradiating device is ultraviolet light.

Accordingly, in the present invention, by irradiating the ink jetted from the recording head with ultraviolet light, the ink is cured and fixed on the recording medium.

The present invention is for the inkjet printer, wherein the ink is a high viscosity cation polymerizable ultraviolet-light curable ink.

In the present invention, image recording is performed using an ink which is a high viscosity ink and in particular a cation polymerizable ultraviolet-light curable ink having a monomer as the main component.

The present invention is for the inkjet printer, wherein the recording medium does not absorb ink.

The present invention performs image recording on a recording medium such as resin or the like which does not absorb ink.

According to the present invention, a constant quantity of ink is always stored in the intermediate tank which is installed near the inlet of recording head and ink needed for image recording is appropriately fed from the intermediate tank to the recording head, and therefore influence caused by pressure loss is reduced to a minimum. Accordingly, even when high viscosity ink is used for image recording, ink can be let to the nozzle of the recording head for jetting only by jetting force of the recording head and it brings an effect to realize constant ink jetting without a back pressure controlling pump or the like.

According to the present invention, detecting whether there is ink remaining in the ink tank can be done by determining whether the intermediate tank has been replenished with ink, and thus unlike the case where the weight of the ink tank is directly detected, other factors such as the parts of the ink tank do not affect detection. In addition, unlike the case in which the print quantity is counted, reduction in the ink quantity due to outflow of ink caused by factors other than image recording can be detected. As a result, the time for replenishing the ink tank with ink can be accurately determined, and this results in the effect that even when image recording is to be continuously performed, ink can be suitably replenished and thus stable image recording operations can be carried out. Further, in the case where there is no ink remaining in the ink tank, this information is relayed by the notifying section and thus the user can know for certain that there is no ink remaining and the effect of performing suitable replenishing of the ink can be achieved.

According to the present invention, by forming a part of the ink chamber of the intermediate tank of a flexible damper membrane, pressure variations of the ink due to the inflow and outflow of ink can be absorbed. In addition, because the damper membrane is kept at a prescribed initial position by an elastic member, when the quantity of ink in the intermediate tank starts to reduce, by pushing back the damper membrane which attempts to bend to the inside the intermediate tank, using a elastic member, a constant negative pressure state is kept inside the intermediate tank. As a result, the effects are achieved of stable jetting of ink from the recording head regardless of inflow or outflow of ink, and leakage of ink from the recording head other than during image recording can be prevented.

According to the present invention, whether a prescribed quantity of ink remains in the intermediate tank can be detected using a simple structure such as a photo-sensor or a pressure sensor. As a result, the quantity of ink remaining in the intermediate tank can be determined without the structure of complex and large intermediate tank, and thus a compact and light device can be realized.

According to the present invention, because high viscosity ink with a viscosity of 10-500 mpa·s at 30° C. is used, high quality image recording can be performed without causing ink flow or the like on the recording medium P even for recording medium P which does not absorb ink. In addition, in the case where this type of high viscosity ink is also used, the effect is seen in which ink pressure loss is reduced and ink jetting can be performed smoothly, and the state where there is no ink remaining in the ink tank can be easily detected.

Because the ink is heated to 30-150° C. and then jetted from the recording head, image recording is performed while the jetting of ink from the nozzle is maintained in a favorable state and furthermore, because jetting can make small droplets such that one dot of the droplets is 2-20 pl, high quality images can be obtained even with high viscosity inks. In addition, in this case also, the effect is seen in which ink pressure loss is reduced and ink jetting can be performed smoothly, and the state where there is no remaining ink in the ink tank can be easily detected.

According to the present invention, because the ink is cured by irradiating ultraviolet light on the ink, image formation is possible on recording medium exhibiting very little ink absorption such as resin films and the like and also in this case, the effect is seen in which ink pressure loss is reduced and ink jetting can be performed smoothly, and the state where there is no ink remaining in the ink tank can be easily detected.

According to the present invention, because the ink is cured by irradiating ultraviolet light on the ink, image formation is possible on recording medium exhibiting very little ink absorption such as resin membranes and the like and in this case also, the effect is seen in which ink pressure loss is reduced and ink jetting can be performed smoothly, and the state where there is no ink remaining in the ink tank can be easily detected.

Furthermore, according to the present invention, even when a high viscosity ink is used, and in particular in the case where a cationic polymerization ultraviolet-light curable ink having a monomer as the main component is used, the effect is seen in which ink pressure loss is reduced and ink jetting can be performed smoothly, and the state where there is no ink remaining in the ink tank can be easily detected.

According to the present invention, in the case where image recording is performed on a recording medium which does not absorb ink such as a resin or the like, because spreading of the ink on the recording medium is prevented, a high viscosity ink can be used, and in this case also, the effect is seen in which ink pressure loss is reduced and ink jetting can be performed smoothly, and the state where there is no ink remaining in the ink tank can be easily detected.

BRIEF DESCRIPTION OF THE DRAWING

FIG. 2(*a*) is a side cross sectional view of the intermediate tank part of inkjet printer related to the present invention. FIG. 2(*b*) is a front view of the intermediate tank part of the inkjet printer related to the present invention.

DETAILED DESCRIPTION OF THE PREFERRED EMBODIMENT

The following is a description of the first embodiment of the inkjet printer of this invention with reference to the accompanying drawings.

Figure 1:
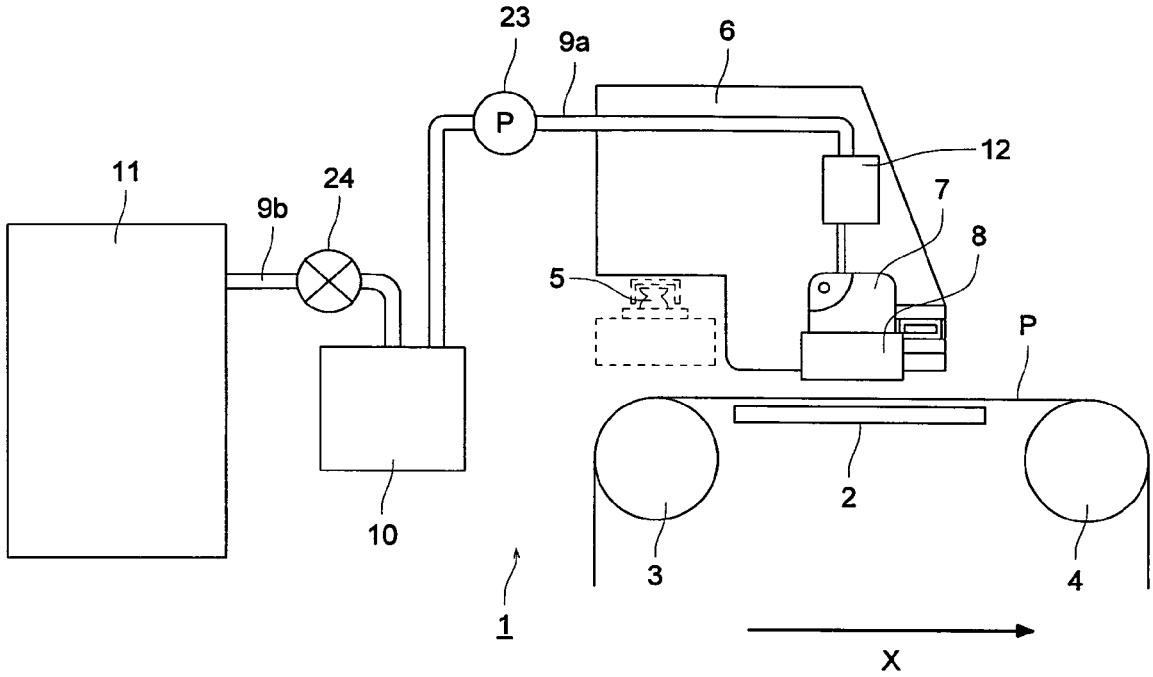
FIG. 1 is a schematic side view showing the main parts of the first embodiment of the inkjet printer related to the present invention.

First, as shown in FIG. 1, in the present embodiment, inkjet printer 1 is a serial print type inkjet printer, and this inkjet printer 1 has flat platen 2 which supports flat recording medium P on its non-recording side. Conveying rollers 3 and 4 which convey the recording medium P while keeping it at substantially the same height as the platen 2 are provided so as to be rotatable at the upstream side and the downstream side respectively of platen 2. Recording medium P is conveyed in prescribed conveyance direction X along the upper surface of platen 2 by recording medium conveying mechanism 30 (See FIG. 3) due to rotation of conveying rollers 3 and 4.

Rod-shaped guide rail 5 which extends in the main scanning direction which is perpendicular to conveyance direction X of recording medium P is provided above platen 2. Carriage 6 supported on guide rail 5, is moved back and forth in the main scanning direction along guide rail 5 by carriage driving mechanism 29 (See FIG. 3).

Recording head 7 which corresponds to all the colors (such as yellow (Y), magenta (M), cyan (C), black (K)) which are used in inkjet printer 1 of the present embodiment is loaded on carriage 6. A plurality of nozzles (not shown) for jetting ink is provided on the surface of recording head 7 opposite recording medium P. Each nozzle has a piezoelectric element (not shown), which deforms when voltage is applied, and when driving voltage is applied, the piezoelectric element deforms and as a result, the flow path for the ink is compressed and ink is jetted from that nozzle. A heater (not shown) is also provided in the ink flow path so that the ink is heated before it is jetted. It is to be noted that in order to achieve high detail image recording, it is desirable that the ink is jetted in small droplets in which one dot is 2-20 pl. Also the ink to be used in inkjet printer 1 is not limited to those given in this example and other colors such as light yellow (LY), light magenta (LM), or light cyan (LC) may also be used. In this case, recording heads corresponding to each of the colors are loaded on carrier 6.

The ink used in the present embodiment is preferably a light curing type ink which has properties that allow curing by irradiating ultraviolet light as the light, and its main components include at least a polymerizable compound (including known polymerizable compounds), photoreaction initiator and coloring materials. The aforementioned photo-curable ink can be broadly classified in two types. One is a radical polymerizable ink containing a radical polymerizable compound as the polymerizable compound and the other is a cation polymerizable ink containing a cation polymerizable compound, either type of which is applicable as the ink used in the present embodiment. Furthermore, a hybrid type ink made of a combination of radical polymerizable ink and cation polymerizable ink can be used for the present embodiment. However, since cation polymerizable ink which has very little or no inhibiting effect on the polymerization reaction due to oxygen, is superior in functionality and versatility, cation polymerizable ink is particularly preferable for use in the present embodiment. The cation polymerizable ink used in the present embodiment is a mixture including at least a cation polymerizable compound such as an oxetane compound, an epoxy compound or a vinyl ether compound, photo-cation initiator and coloring material.

It is to be noted that the ink used in the present embodiment is a high viscosity ink which has a viscosity of 10-500 mpa·s at 30° C. Because viscosity of an ink is reduced due to heating, even when high viscosity ink is to be smoothly jetted as ink droplets, in order to make it possible to accurately deposit the ink particles on the recording medium and perform high-definition recording, it is preferable that the ink prior to jetting is heated to a temperature of 30° C. to 150° C. using a heater.

Ultraviolet light irradiating device 8 which is inside carriage 6 and has substantially the same length dimensions as the length of recording head 7 in recording medium conveyance direction X is disposed in an extended position in the longitudinal direction of recording head 7 between the side wall of carriage 6 and recording head 7. Ultraviolet light irradiating device 8 has an ultraviolet light source which is not shown. It is to be noted that examples of usable ultraviolet light sources include a high and low pressure mercury vapor lamps, a metal halide lamp, a semiconductor laser, a cold cathode tube, an excimer lamp and an LED (light emitting diode) and the like. It is also to be noted that the position where ultraviolet light irradiating device 8 is provided is not limited to the position described above and it may be provided for example, between recording heads 7.

Each of recording heads 7 has connected thereto sub-tank 10 for temporarily storing ink of each of the colors yellow (Y), magenta (M), cyan (C), and black (K). Each sub-tank is connected via ink supply pipes 9*a* which are each formed of a flexible material. In addition, each sub-tank 10 is connected to a main tank 11 via respective ink supply pipes 9*b*. The ink in each main tank 11 is supplied to the respective sub-tanks 10 by the ink supply pipe 9*b*, and after being temporarily stored in sub-tank 10, the ink is supplied to respective recording heads 7. It is to be noted in FIG. 1 that sub-tank 10 is provided at a position lower than recording head 7, so that the ink inside recording head 7 is maintained at a negative pressure and ink does not leak out other than during image recording.

Sub-tank 10 has sub-tank sensor 27 to detect its quantity of ink stored inside. Sub-tank sensor 27 may, for example, detect the liquid surface for the ink stored in sub-tank 10 and depending on whether the liquid surface of the ink is above a prescribed height, a determination is made as to whether the ink quantity in sub-tank 10 is more than a prescribed quantity. It is to be noted that sub-tank sensor 27 is not limited to the configuration described in this example, and a weight sensor can also be used for this detection provided that it can detect the ink quantity inside sub-tank 10.

In addition, as shown in FIG. 2, intermediate tank 12 which has ink chamber 13 which stores ink in the inside thereof is provided in the path of ink supply pipe 9*a* and is between sub-tank 10 and recording head 7. Intermediate tank 12 is provided so as to be close to recording head 7. By disposing intermediate tank 12 close to recording head 7 in this manner, when the ink is to be jetted, because it is sufficient that the ink stored in intermediate tank 12 is supplied to recording head 7, the effect of pressure loss on ink jetting which occurs when ink flows in ink supply pipes 9*a* and 9*b* can be minimized. As a result, even if high viscosity ink is used for image recording, the occurrence of ink jetting defects due to pressure loss can be prevented.

One end of the upper part of intermediate tank 12 in FIG. 1 and FIG. 2 has ink inlet port 14 which allows ink to flow into ink chamber 13, while at the lower part of intermediate tank 12, ink outlet 15 allows ink to flow from ink chamber 13. Ink inlets 14 and 15 respectively are connected to ink supply pipes 9*a* and the ink sent from the sub-tank flows into ink chamber 13 from ink inlet 14 via ink supply pipe 9*a* and the ink which flows into ink chamber 13 is sent to recording head 7 from ink outlet 15 via ink supply pipe 9*a*.

Opening 16, formed on one side surface of ink chamber 13, has damper membrane 17 pasted thereon. Damper membrane 17 may be formed of a flexible film such as a polyethylene or the like, and by heat adhesion of the film to opening 16, the opening is sealed. It is to be noted that the material used for the flexible membrane forming damper membrane 17 is not necessarily limited to that given as an example herein, but because some materials are corroded by the ink used in image recording, it is preferable that at least the portion of a material that comes into contact with the ink is not a corrosible material which would cause damper membrane 17 to deteriorate due to contact with the ink which is stored inside ink chamber 13.

The interior wall surface of ink chamber 13 which opposes opening 16 has coil spring 18 which is an elastic member provided such that one end contacts damper membrane 17. Coil spring 18 supports damper membrane 17 at a prescribed initial position when the ink flows into ink chamber 13 of intermediate tank 12.

The initial position herein refers to the position where there is equilibrium between the force of the ink, which has flowed into intermediate tank 12 and is drawn toward recording head 7 due to its dead weight and the force of coil spring 18 structured at such as a position of the membrane surface of damper membrane 17 to result in a state of constant negative pressure. When the ink flows into ink chamber 13 of intermediate tank 12, damper membrane 17 is pressed by the ink and bends toward the outer side. Conversely, when the ink quantity in ink chamber 13 is reduced due to the ink being jetted from recording head 7, damper membrane 17 accordingly bends toward the inner side. At this time, coil spring 18 is pressed to contract by damper membrane 17, and as a result a repulsive force is generated so that coil spring 18 attempts to return to its initial length. Whereby, damper membrane 17 is pushed back to its initial position by the repulsive force of coil spring 18, and equilibrium between coil spring 18 and damper membrane 17 which is attempting to bend to the inner side is established and a negative pressure state is achieved inside ink chamber 13. By maintaining a negative pressure state inside ink chamber 13, ink is prevented from leaking from the nozzle of recording head 7 at times other than during image recording. In this embodiment, coil spring 18 is used as the elastic member for supporting damper membrane 17, but the elastic member can be any stretchable material, and is not limited to coil spring 18. Accordingly, other types of spring such as a plate spring or materials such as an stretchable resin may be employed.

Membrane surface detecting sensor 19 to detect the position of the membrane surface of damper membrane 17 is provided at a vicinity of damper membrane 17 which is at the outer side of intermediate tank 12, as a ink remaining quantity detector for detecting the remaining quantity of ink stored in ink chamber 13 of intermediate tank 12. Membrane surface detecting sensor 19 has rod 20 which is formed so as to allow the front end of the rod to contact damper membrane 17 having a length which is longer than the length equivalent to the difference between the position when damper membrane 17 bends farthest to the outer side and the position when it bends furthest to the inner side. Rod 20 advances toward or retreats against damper membrane 17, incorporated in an actuator such as a cylinder or the like, and therefore protrudes forward or moves backwards according to damper membrane 17 so that the front end of rod 20 is always in contact with damper membrane 17. Membrane surface detecting sensor 19 includes light-emitting device 21 incorporating a light-emitting element, which emits infrared light and the like and light-receiving device 22 incorporating the light-receiving element, which senses the emitted light from light-emitting device 21. Rod 20 is interposed between light-emitting device 21 and light-receiving device 22 which are disposed such that the light-emitting surface of light-emitting device 21 (not shown) and the light-receiving surface of light-receiving device 22 oppose each other.

When ink flows into intermediate tank 12, damper membrane 17 is pressed to the outside, and rod 20 which is always in contact with damper membrane 17 is pressed. When rod 20 is pressed and pushed farther in than the position where light-emitting device 21 and light-receiving device 22 are provided inside membrane surface detecting sensor 19, the light emitted from light-emitting device 21 is shielded by rod 20 and can not be received by light-receiving device 22. On the other hand, when the ink quantity inside intermediate tank 12 is reduced, damper membrane 17 bends to the inside of intermediate tank 12 and rod 20 then protrudes. When the end of rod 20 passes the position where light-emitting device 21 and light-receiving device 22 are provided, light-receiving device 22 receives the light emitted from light-emitting device 21. As a result, it is possible to detect that the end of rod 20 is on the membrane side of the prescribed position, and it is determined that the position of the membrane surface of damper membrane 17 which is in contact with the front end of rod 20 is bending to the inside beyond a prescribed position.

When the quantity of ink in the ink chamber is reduced, damper membrane 17 bends in the inner direction of ink chamber 13. Further, it is necessary for a constant negative pressure to be exerted in order to prevent ink from leaking from the nozzle of recording head 7. When damper membrane 17 bends to the inside, coil spring 18 presses against damper membrane 17 back to the initial position using the repulsive force, and as a result, a state of negative pressure is generated in ink chamber 13 of intermediate tank 12 and also inside ink supply pipe 9*a* from intermediate tank 12 to head 7. On the other hand, in order to make a suitable quantity of ink to be jetted from the nozzles, it is necessary for a prescribed pressure to be exerted on the nozzle of recording head 7 due to the weight of the ink stored in intermediate tank 12 and in ink supply pipe 9*a* between intermediate tank 12 and recording head 7. In addition, in the case where more ink than a prescribed quantity is stored in intermediate tank 12, the appropriate pressure for the nozzle can be ensured, and the ejection of ink can be performed smoothly due to the force within recording head 7. However, when the negative pressure generated in intermediate tank 12 and in ink supply pipe 9*a* up to the location of recording head 7 exceeds a prescribed limit, the ink is in a state in which it cannot be appropriately jetted using only the ink jetting force of the recording head. For example, the jetting force by which recording head 7 can appropriately jet the ink is generally about −300 Pa, and when a greater negative force than this is applied, it is no longer possible for the ink to be appropriately jetted from the nozzle, causing jetting abnormalities. Thus, in order to maintain a suitable pressure in the nozzles, and whether the amount of ink remaining inside intermediate tank 12 is kept at a constant quantity is suitably detected by detecting the membrane surface position of damper membrane 17 using membrane surface detecting sensor 19.

Liquid feeding pump 23 to feed ink to intermediate tank 12 is provided between intermediate tank 12 and sub-tank 10 which are connected by ink supply pipe 9*a*. When it is determined that the quantity of ink in intermediate tank 12 is less than a prescribed quantity, the ink stored in sub-tank 10 fed by force into intermediate tank 12. It is to be noted that various types of pumps such as a diaphragm pump, or a gear pump and the like may be suitable as liquid feeding pump 23.

As liquid feeding pump 23, a metering pump which feeds a constant quantity of liquid per each driving unit (stroke) is preferable. Regarding a metering pump, various types of pumps such as, a diaphragm pump, a gear pump, a plunger pump, a snake pump and a rotary pump are applicable.

Since intermediate tank 12 is installed between the metering pump and recording head 7, the metering pump of the present embodiment is not necessarily required to maintain a uniform discharge during one stroke. The pump is required to provide a constant quantity of discharge per each stroke rather than that.

For feeding ink of viscosity of 10 to 500 mPa·s at 30° C., a plunger pump is preferably employed. A plunger pump is advantageous because it can supply a very small quantity of liquid, conduct high precision measurement of liquid quantity, and supply high pressure liquid, and further it has a high degree of freedom for selecting materials composing the pump. It is preferable that members of a plunger pump which are in contact with ink are formed of materials which have a high resistance of deterioration against reactive ink to be fed such as stainless steel, ceramic, fluorine resin, in order to maintain a stable feeding quantity of liquid per each stroke for a long time.

It is preferable that a feeding quantity of the metering pump per one stroke is relatively small. If the quantity per one stroke is small, variations of the quantity between strokes are offset to be leveled and the quantity becomes preferably close to a prescribed one. In the present embodiment, it is preferable that the feeding quantity per one stroke is 1% or more without exceeding 30% of the volume which intermediate tank 12 can damp down and more preferably 1% or more without exceeding 5%. The error of the feeding quantity of the metering pump per one stroke is preferably within ±5%.

Since liquid feeding pump 23 is a metering pump which supplies a constant feeding quantity per each stroke, the used amount of ink can be easily and precisely detected by counting the total number of operation strokes. Further, by counting the total number of strokes of liquid feeding pump 23 after main tank 11 is loaded, a high precision detection of the quantity of remaining ink in main tank 11 is possible. By this means, it can be prevented that a continuous operation of liquid feeding pump 23 brings air into ink supply pipe 9*b* and intermediate tank 12 after main tank 11 becomes empty. Therefore, there is no waste of ink to remove air from ink supply pipe 9*b* and intermediate tank 12. The ink feeding rate per unit time of liquid feeding pump 23 may be appropriately set according to the volume which intermediate tank 12 can damp down and the ink discharge rate of ink head 7 per unit time, however it is preferable to satisfy the following relationship in consideration of delay time from a detection of necessity of ink replenishment by membrane surface detecting sensor 19 until actual ink supply by liquid feeding pump 23 (for example, 0.1 to 2 seconds). (Volume which intermediate tank 12 can damp down)>(Feeding rate of ink per unit time by liquid feeding pump 23)×(delay time).

In addition, supply valve 24 which restricts inflow of ink from main tank 11 to sub-tank 12 is provided in the path of ink supply pipe 9*b*. Supply valve 24 is an electromagnetic valve which has, for example, a solenoid and a diaphragm (neither of which is shown), and opening and closing of the valve is performed by activating and deactivating the solenoid according to the outflow or inflow of liquid in the diaphragm. The mechanism for controlling the inflow and outflow of ink is not limited to this mechanism and various valves having other structures, or mechanisms, may be Used.

Inkjet printer 1 has display section 28 as a notifying section to notify the user when a determination is made that there is no ink remaining in main tank 11. Display section 28 may for example be formed of a liquid crystal display featuring a TFT (thin film transistor), and displays which main tank 11 has no remaining among main tanks 11 which store ink of each of the color. In addition to displays related to the quantity of ink remaining in main tank 11, display section 28 may also display various other information such as the conditions for image recording.

Examples of suitable recording medium P which may be used in this embodiment is a recording medium made of various kinds of materials including various types of paper such as normal paper, recycled paper, and glossy paper, various fabrics, various non-woven fabrics and substances which do not have ink absorbing properties such as resins, metals, glass and the like. Suitable recording medium P may be used in various forms such as rolls, cut sheets, plates and the like.

Figure 3:
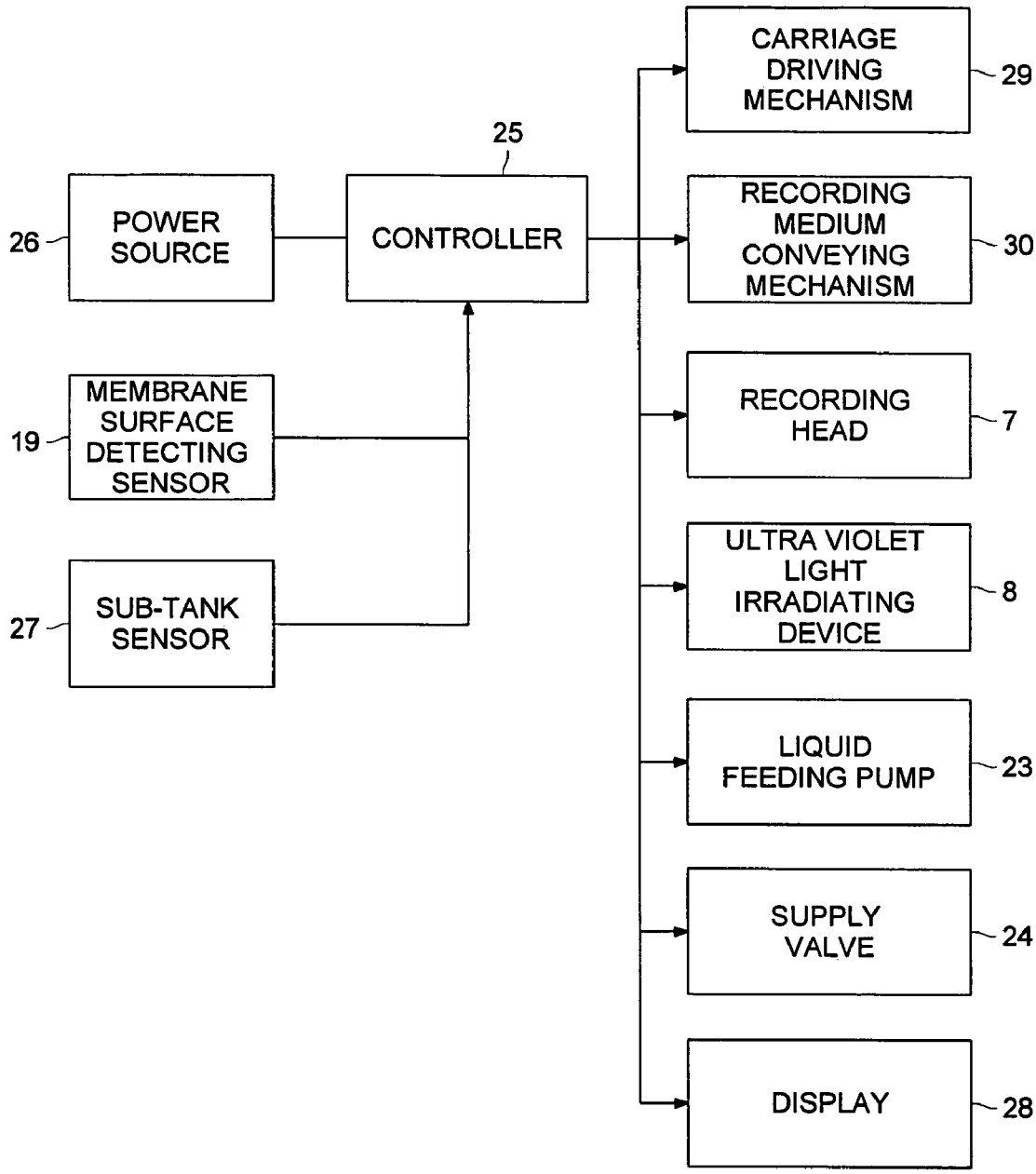
FIG. 3 is a block diagram of main parts showing outline of the control structure of the first embodiment of the inkjet printer related to the present invention.

Next, the control configuration for inkjet printer 1 of this embodiment will be described with reference to FIG. 3.

Inkjet printer 1 includes controller 25 for controlling all the parts of inkjet printer 1, and controller 25 is connected to power source 26 which supplies electrical power to inkjet printer 1.

The detected data of the extent to which the membrane surface of damper membrane 17 is bent toward the inner side of ink chamber 13 of intermediate tank 12 is sent to controller 25 from membrane surface detecting sensor 19 as electrical signals. Controller 25 determines whether there is ink remaining in ink chamber 13 of intermediate tank 12 based on the detected results, and if it is determined that there is no ink remaining in ink chamber 13, liquid feeding pump 23 is actuated and ink from sub-tank 10 is supplied to intermediate tank 12. It is to be noted that the detection of the membrane surface of damper membrane 17 by membrane surface detecting sensor 19 is performed during image recording when carriage 6 is moving at a constant speed. When carriage 6 is performing image recording while moving back and forth on platen 2, the speed of movement must be constant in order to perform stable image recording. However, because there is no need to perform high precision control at times other than during image recording, the movement speed of carriage 6 may be increased or the speed may be reduced in order to change direction of movement of carriage 6 and as a result the speed of movement of carriage 6 is not constant. In addition, when recording head 7 is being cleaned, because forced ink absorption or air jetting is performed, rapid variation in the ink quantity inside ink chamber 12 is caused. Thus, even if detection of the membrane surface of damper membrane 17 is performed at times other than during image recording when carriage 6 is moving at a constant speed, it cannot be expected that accurate values will always be obtained. The actual detection of the membrane surface may be performed only at the time of image formation. Alternatively, detection may be performed at all times or at prescribed intervals and controller 25 may perform the determination of whether there is ink remaining in ink chamber 13 based only on the result of detection performed during image recording.

If controller 25 determines that there is no ink in ink chamber 13 of intermediate tank 12 based in the signals sent from membrane surface detecting sensor 19, controller 25 actuates liquid feeding pump 23 accordingly and an appropriate quantity of ink which can be stored in ink chamber 13 is pumped from sub-tank 10 to intermediate tank 12 and the quantity of ink stored in ink chamber 13 of intermediate tank 12 is thereby kept at a constant quantity.

The detected results for the quantity of ink in each of sub-tanks 10 are sent from sub-tank sensor 27 to controller 25 as electrical signals. When controller 25 determines from the detected results that the quantity of ink remaining in sub-tank 10 is less than the prescribed quantity, supply valve 24 is actuated and supply valve 24 is opened only for a prescribed time and the ink in each main tank 11 is supplied to each corresponding sub-tank 10. It is to be noted that the time for which feeding valve 24 is open may be a time set in advance for a time such as 10 seconds, 20 seconds or the like, and supply valve 24 will be open only for the set time. The time during which supply valve 24 is open may be set respectively according to the type of ink and the like.

In the case where it is determined from the membrane surface position information of damper membrane 17 which is constantly sent from membrane surface detecting sensor 19, that the position of the damper membrane 17 does not change even when liquid feeding pump 23 is actuated, controller 25 determines that there is no ink remaining in main tank 11. In the case where there is no change in the position of the membrane surface of damper membrane 17, the time from the actuation of liquid feeding pump 23 until controller 25 determines if there is no ink remaining in the main tank may be changed in accordance with various conditions such as the type of ink, the ambient temperature and the like. In the case where the viscosity of the ink is high or in the case where the ambient temperature is low, the flow rate of the ink is slower than when the viscosity of the ink is low or the like, and even if liquid feeding pump 23 is actuated, it takes a specific amount of time for the ink to reach ink chamber 13 of intermediate tank 12, and thus the time it takes for the ink to reach ink chamber 13 of intermediate tank 12 after the pump is actuated is sometimes influenced by the viscosity of the ink and the like.

If it is determined that there is no ink remaining in main tank 11, controller 25 controls display section 28 and allows it to display information on the color of the ink of which there is no more remaining ink in main tank 11.

Furthermore, controller 25 also controls carriage driving mechanism 29 and moves the carriage back and forth in the main scanning direction and also repeats conveying and stopping of recording medium P to correspond with the operation of carriage 6. The controller controls recording medium conveying mechanism 30 such that the recording medium P is intermittently conveyed in the conveyance direction X and conveyance rollers 3 and 4 are actuated.

Controls section 25 also actuates recording head 7 and heats the ink inside the ink flow path of recording head 7 to 30° C.-150° C., and the ink is jetted onto recording paper P as small droplets in which one dot is 2-20 pl, and a prescribed image formation is thereby performed. Furthermore, controller 25 controls ultraviolet light irradiating device 8 such that ultraviolet light is irradiated from an ultraviolet light source onto the ink which has been deposited onto recording medium P.

Next, the effects of the present embodiment will be described.

When light source 26 of the inkjet printer 1 is turned ON, each of the parts of the inkjet printer 1 is electrically energized with power source 26, and carriage 6 on which recording head 7 is loaded is positioned above platen 2.

When carriage 6 arrives at a prescribed position, recording medium P is conveyed in conveyance direction X by conveyance rollers 3 and 4, and simultaneously, carriage 6 moves back and forth in the main scanning direction. At this time, a prescribed voltage is applied to the piezoelectric element of recording head 7 and the ink flow path is thereby compressed, and due to this jetting force, the ink inside ink chamber 13 of intermediate tank 12 is pulled into the flow path of recording head 7, and further ink of the required color is jetted from the nozzle based on prescribed image information. Still further, the ink which has been jetted is irradiated with ultraviolet light from ultraviolet light irradiating device 8, and as a result, a prescribed image is recorded on recording medium P.

When ink is jetted from recording head 7, the ink stored in ink chamber 13 of intermediate tanks 12 is sequentially fed to recording head 7, and the ink volume in the ink chamber is reduced, and which subsequently causes damper membrane 17 to bend towards the interior of ink chamber 13 as a result of the ink volume in the ink chamber being reduced. When damper membrane 17 bends inward toward the interior, coil spring 18 resists damper membrane 17 and pushes it back to the initial position using repulsive force, and as a result the inside of ink chamber 13 of intermediate tank 12 and ink supply pipe 9*a* extending from intermediate tank 12 to recording head 7 develops a negative pressure state. The membrane surface position of damper membrane 17 is detected from time to time by membrane surface detecting sensor 19 and the results of the detection are sent to controller 25.

Damper membrane 17 resists coil spring 18 and if it is detected that damper membrane 17 bends further toward the inside than a prescribed position, then a quantity of ink which can be stored in ink chamber 13 is sent from the sub-tank 10 by liquid feeding pump 23. If ink is appropriately sent, damper membrane 17 is pressed outward due to the pressure of ink which flows into ink chamber 13, and as a result rod 20 of membrane surface detecting sensor 19 is pressed by damper membrane 17 and is pushed back inside the main body of membrane surface detecting sensor 19, and as a result, a change in position of damper membrane 17 is determined.

The quantity of ink remaining in sub-tank 10 is detected by remaining quantity detection sensor 19, and whenever the quantity of ink remaining in sub-tank 10 is reduced beyond a prescribed quantity, supply valve 24 is opened and the required quantity of ink is supplied to sub-tank 10 from main tank 11 via ink supply pipe 9*b*. As a result, a constant quantity of ink is always stored in sub-tank 10.

If ink does not flow into ink chamber 13 even when liquid feeding pump 23 is actuated and membrane surface detecting sensor 19 does not detect a change in the membrane surface position of damper membrane 17, a determination is made that there is no ink remaining in sub-tank 10 and it means that there is no ink remaining in main tank 11 which feeds ink to sub-tank 10. Accordingly, an indication is shown on display section 28 that there is no ink remaining in main tank 11.

As described above, according to this embodiment, the membrane surface position of damper membrane 17 is detected, and a determination can be made as to whether intermediate tank 12 has been replenished with ink and detection whether there is ink remaining in main tank 11. Thus, accurate detection of the remaining quantity of ink in main tank 11 can be performed using a simple configuration and the time for replenishing main tank 11 with ink can be suitably determined.

In addition, because display section 28 displays information indicating that there is no ink remaining in main tank 11, the user can easily determine the time for ink replenishing.

Furthermore, in this embodiment, because intermediate tank 12 is provided in a vicinity of recording head 7, recording head 7 receives sequential ink supply from intermediate tank 12 and the effect of pressure loss of the ink supplied to recording head 7 in ink supply pipe 9*a* is suppressed to a minimum. Thus, even in the case where high viscosity ink is used to perform image recording, the ink can be jetted by being led to the nozzle of recording head 7 due to suction force from jetting of recording head 7.

Also, in this embodiment, intermediate tank 12 has damper membrane 17 which is formed of a flexible material, and because this damper membrane 17 is kept at the initial position by coil spring 18, a negative pressure state is generated inside intermediate tank 12, and this prevents the ink from leaking form the nozzle of recording head 7.

Figure 4:
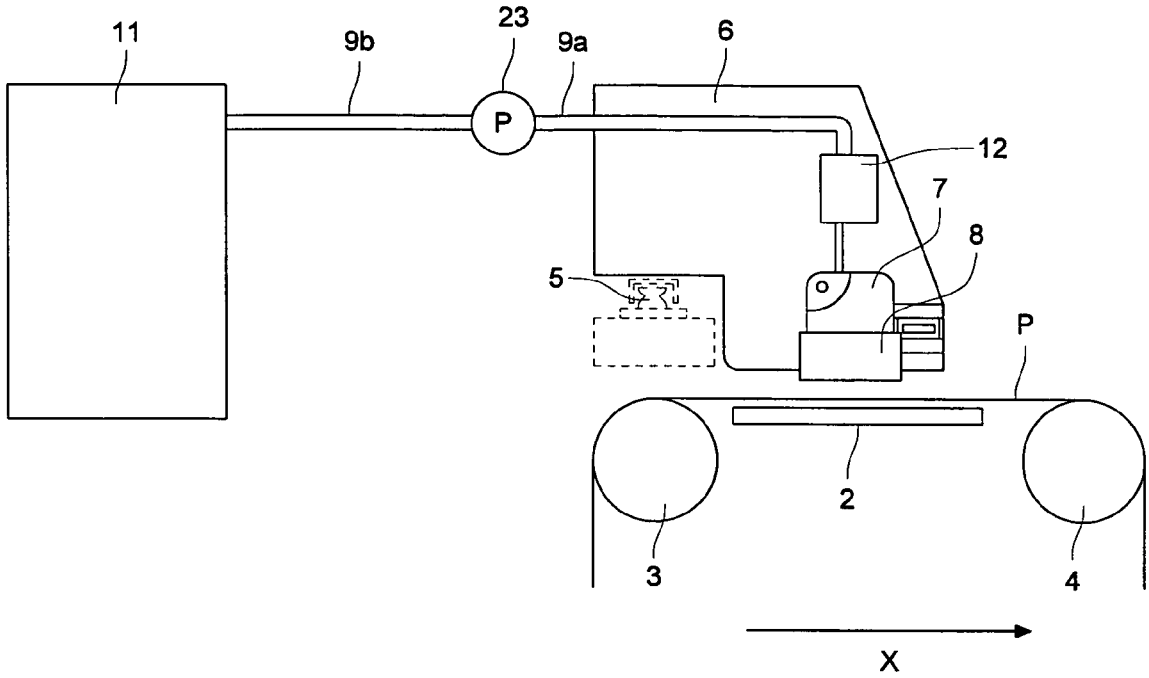
FIG. 4 is a side view showing modified example of the first embodiment of the inkjet printer related to the present invention.

It is to be noted that in this embodiment, the configuration is such that sub-tank 10 is provided along with intermediate tank 12, and the ink inside main tank 11 is first supplied to the sub-tank 10 and then to intermediate tank 12, but as shown in FIG. 4 the configuration may be such that sub-tank 10 is not provided, and ink in main tank 11 is directly supplied to intermediate tank 12. In this case, supply valve 24 between main tank 11 and sub-tank 10 is no longer necessary, and the device configuration is made simple. Sub-tank 10 performs control such that a constant negative pressure state is maintained in recording head 7 and in ink supply pipe 9*a* and has the role of preventing ink from leaking recording head 7 at times other than when image recording is being done. However, in this embodiment, the negative pressure state of recording head 7 and in ink supply pipe 9*a* is maintained by damper membrane 17 of intermediate tank 12 and coil spring 18. Thus, even in the configuration in which sub-tank 10 is not provided, the ink does not leak from the nozzles of recording head 7.

In this embodiment, display section 28 is provided as a notifying section for notifying the user that there is no ink remaining in main tank 11, but the notifying section is not limited thereto. For example, the user may be notified that there is no ink remaining in main tank 11 by providing a sound output section and generating a warning sound, or providing a warning lamp and lighting up the lamp.

The inkjet printer which may be suitably used as inkjet printer 1 of this invention can use recording head 7 of the on-demand type or the continuous type. In addition, examples of the inkjet type include any with recording head 7 selected from among the electricity-machine conversion type (such as the single cavity type, the double cavity type, the bender type, the piston type, the share mode type, and the shared wall type), the electricity-heat conversion type (such as the thermal inkjet type, the bubble jet (registered trademark) type and the like), the electrostatic suction type (such as the electron field control type, and the slit jet type), and the electric discharge type (such as the spark jet type).

In addition, in this embodiment, image recording is performed by using ink which cures by being irradiated with ultraviolet light, but the ink is not necessarily limited to this type and inks which are cured by irradiating light other than ultraviolet light like electromagnetic waves such as electron beams, X-rays, visible light, infrared light may also be used. In this case, a polymerizable compound which is polymerized and cured by light other than ultraviolet light and a photoreaction initiator which initiates a polymerization reaction between the polymerizable compounds using light other than ultraviolet light are applied. In addition, in the case where a cure type ink which is cured by light other than ultraviolet light is used, the ultraviolet light source is replaced and a light source which irradiates the relevant light is used instead. Furthermore, ink which is cured and fixed without being irradiated with light may also be used. In this case it is unnecessary to provide the ultraviolet light irradiating device.

In this embodiment inkjet printer 1 is a serial head type inkjet printer in which images are formed by moving recording head 7 which is loaded on carriage 6, back and forth in the main scanning direction, and also jetting ink from recording head 7 while conveying recording medium P in conveyance direction X. However, inkjet printer 1 relating to this invention may also be a line head type inkjet printer in which images are formed by jetting ink from the recording head which is fixed on the printer main body and conveying the recording medium.

Also, it is a matter of course that this invention is not limited to the embodiment described above and suitable modifications are possible.

Figure 5:
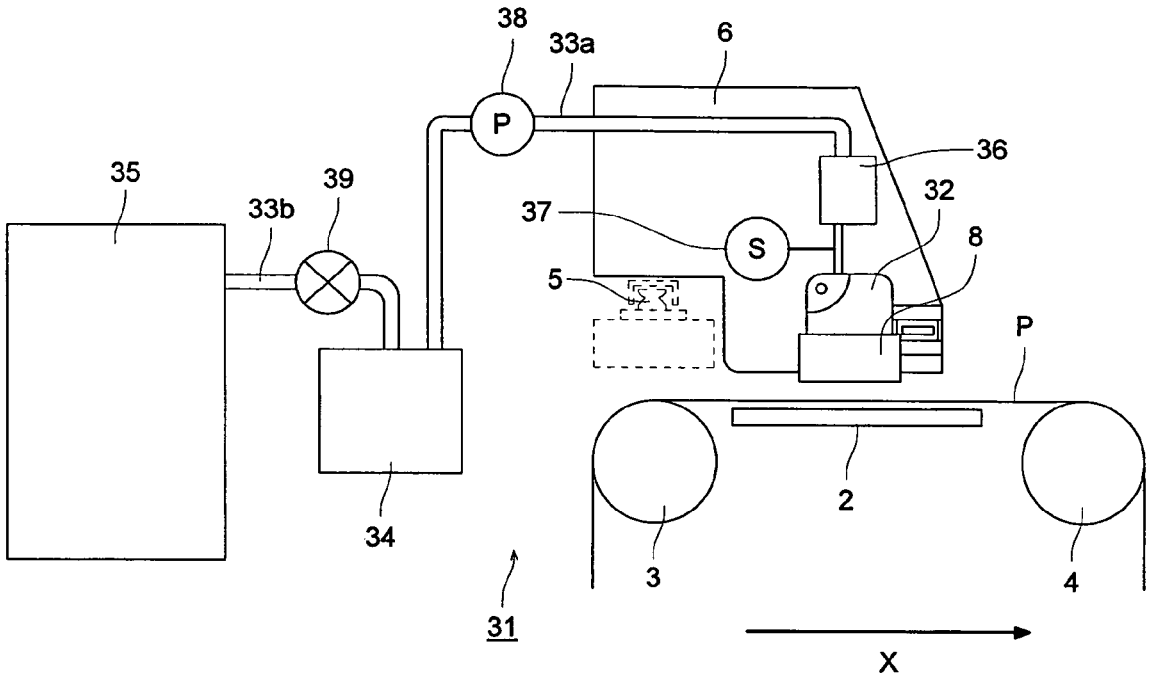
FIG. 5 is a schematic diagram showing the main parts of the second embodiment of the inkjet printer related to the present invention.

Next, a second embodiment of the printer head relating to this invention will be described with reference to FIG. 5. In the second embodiment, only the configuration of the remaining quantity detector which detects the quantity of ink in the intermediate tank is different from in the first embodiment, and thus the remaining quantity detector in particular is described in the following.

In this embodiment, inkjet printer 31 includes: recording head 32 for jetting ink, main tank 35 for supplying ink to recording head 32; and a sub-tank 34 for temporarily storing ink sent from main tank 35. Recording head 32 and sub-tank 34, as well as sub-tank 34 and main tank 35 are connected by ink supply pipes 33*a* and 33*b* respectively, and ink is sequentially supplied to recording head 32.

Intermediate tank 36 is provided on the path of ink supply pipe 32*a* and is between sub-tank 34 and recording head 32 and has therein an ink chamber (not shown) which stores ink, similarly to the first embodiment.

One side surface of the ink chamber of intermediate tank 36 has an opening which is not shown formed therein, and the opening has a damper membrane (not shown) pasted thereon which may be formed of a flexible film such as a polyethylene film or the like. When ink flows into intermediate tank 36, the damper membrane is pressed and bends toward the outside because of the ink, and conversely, when the quantity of ink in intermediate tank 36 is reduced due to the outflow of ink to the recording head, the damper membrane bends toward the inside.

The wall surface which is inside the ink chamber and opposes the opening has a coil spring (not shown) which is an elastic member which is provided such that one end contacts the damper membrane. The coil spring supports damper membrane 11 at a prescribed initial position when the ink flows into the ink chamber of intermediate tank 36.

Pressure sensor 37 which detects variation in the pressure of the ink that flows out from intermediate tank 36 is provided on the path of ink supply pipe 33*a* between intermediate tank 36 and recording head 32 as a remaining quantity detector for detecting the quantity of ink remaining in the intermediate tank.

Pressure sensor 37, may for example be one in which a bridge circuit is formed on a silicone substrate and the change in electrical resistance is utilized when tension is applied to a semiconductor crystal or when it is subjected to compression, and the resistance value which changes due to pressure is converted to electrical signals and extracted. Examples of the pressure sensors used include a piezoelectric element made of ceramics, polymerized piezoelectric material such as polyvinylidene fluoride, a single crystal piezoelectric element such as lithium niobate, a magnetorestrictor which generates pressure magnetism capable of electric conversion such as magnetorestrictive ferrite, a piezoelectric material which electrically converts strain such as strain gauge. These are used to determine changes in pressure by detecting changes in the electric resistance.

When there is sufficient ink in intermediate tank 36, the pressing force by which the ink attempts to flow out to recording head 32 is strong and a great amount of pressure is exerted on ink supply pipe 33*a* located between the intermediate tank 36 and the recording head 32. However, when the quantity of ink remaining in intermediate tank 36 becomes low, the pressing force by which the ink attempts to flow out to recording head 32 becomes weak and a small amount of pressure is exerted on ink supply pipe 33*a* located between intermediate tank 36 and recording head 32. Thus the relationship between the amount of ink in intermediate tank 36 and the pressure exerted on ink supply pipe 33*a* is measured in advance and by the setting beforehand, a determination can be made as to the level of the value detected by pressure sensor 37 that indicates that there is no ink remaining in intermediate tank 36.

Liquid feeding pump 38 for feeding ink is provided between intermediate tank 36 and sub-tank 34, and when a determination is made that the quantity of ink in intermediate tank 36 is less than a prescribed quantity, the ink stored in sub-tank 34 is forcefully pumped.

Ink supply valve 39 for restricting the inflow of ink from the main tank 35 to sub-tank 34 is provided on the path of ink supplying tube 33*b*.

Inkjet printer 31 has a display section which is not shown, similarly to the first embodiment and it appropriately displays information indicating that there is no ink remaining in main tank 35 or other information.

Inkjet printer 31 of this embodiment includes a controller (not shown) which is substantially the same as that of the first embodiment and the controller operates pressure sensor 37, liquid feeding pump 38, and supply valve 39, and a display section. In addition, the controller drives the carriage 6 and also forms a prescribed image by jetting ink from recording head 32 based on prescribed image signals.

It is to be noted that the other configurations are the same as those of the first embodiment and thus the same positions have been assigned the same numbers and descriptions thereof have been omitted.

Next the effects of this embodiment will be described.

When image recording operations are performed based on prescribed image signals and ink is jetted from recording head 32, the ink stored in the ink chamber of intermediate tank 36 is sequentially supplied to recording head 32. The damper membrane bends towards the inside of the ink chamber as a result of the ink quantity in the ink chamber being reduced. When the damper membrane bends toward the inside, the coil spring attempts to push back it to the initial positions due to the repulsive force of the coil spring. As a result the inside of the ink chamber of intermediate tank 36 and the ink supply pipe 33*a* extending from intermediate tank 36 to recording head 32 develops a negative pressure state.

Variation in the pressure exerted on the area of ink supply pipe 33*a* between intermediate tank 36 and recording head 32 is detected by pressure sensor 37. In the case where the pressure exerted on ink supply pipe 33*a* is less than a prescribed pressure, a determination is made that the quantity of ink the intermediate tank 36 is less than a prescribed quantity, and a quantity of ink which can be stored in the ink chamber is sent from sub-tank 34 by liquid feeding pump 38. When the ink is suitably sent, the pressure exerted on ink supply pipe 33*a* in the area between intermediate tank 36 and recording head 32 is increased, and this change in pressure is detected by pressure sensor 37. The controller may stop liquid feeding pump 38 to feed ink when a predetermined quantity of ink has been fed or when pressure sensor 37 detects that the pressure exerting on ink supplying pump 33*a* has reached a prescribed value.

Meanwhile, when ink does not flow into the ink chamber even when liquid feeding pump 38 is actuated and there is no change in the pressure exerted on ink supply pipe 33*a* in the area between the intermediate tank 36 and recording head 32, a determination is made that there is no ink remaining in sub-tank 34, and it means that there is no ink remaining in main tank 35 which feeds ink to sub-tank 34. Accordingly, a display is shown at the display section to indicate that there is no ink remaining in main tank 35.

As described above, according to this embodiment, accurate detection of the remaining quantity of ink in main tank 35 can be performed using a simple configuration by providing pressure sensor 37 in the area of the ink supply pipe 33*a* between intermediate tank 36 and recording head 32 and the time for replenishing main tank 35 with ink can be suitably determined.

In addition, because the display section displays information indicating that there is no ink remaining in main tank 35, the user can easily determine the time for ink replenishing.

Furthermore, in this embodiment, because intermediate tank 36 is provided in a vicinity of recording head 32, recording head 32 can sequentially receive ink supply from intermediate tanks 36 and the effect of pressure loss in ink supply pipe 33*a* on the ink supplied to recording head 32 is suppressed to a minimum. Thus, even in the case where high viscosity ink is used to perform image recording, the ink can be jetted by being led to the nozzle of recording head 32 due to the jetting force of recording head 32.

Also, in this embodiment, intermediate tank 36 has a damper membrane which is formed of a flexible material, and because this damper membrane is kept at its initial position by a coil spring, a negative pressure state is generated inside the intermediate tank 36, and this prevents the ink from leaking from the nozzle of recording head 32.

It is to be noted that similarly to the first embodiment, this invention is not to be limited by this embodiment.

What is claimed is:

1. An inkjet printer comprising:

an ink tank to store ink;

a recording head to jet the ink onto a recording medium;

an ink supply pipe to supply the ink from the ink tank to the recording head;

an intermediate tank having a damping function against pressure fluctuation to store the ink at a position on the ink supply pipe between the ink tank and the recording head, the intermediate tank comprising an ink chamber to store the ink including, a damper membrane which is flexible and installed at least on one surface of the ink chamber and an elastic member to maintain the damper membrane at a prescribed initial position;

the inkjet printer further comprising:

a liquid feeding pump located between the ink tank and the intermediate tank to feed the ink to the intermediate tank and;

a remaining quantity detector for detecting a quantity of remaining ink in the intermediate tank by detecting a position of the damper membrane, and a controller to control the liquid feeding pump to feed the ink in the ink tank to the intermediate tank when the remaining quantity detector detects that the quantity of remaining ink in the intermediate tank is less than a prescribed quantity.

2. The inkjet printer of claim 1, comprising:

a notifying device to provide notification when there is no remaining ink in the ink tank;

wherein the controller makes judgment that there is no remaining ink in the tank, when the remaining quantity detector does not detect increase of the quantity of remaining ink in the intermediate tank, even when the liquid feeding pump is operated, and a result of the judgment is notified by the notifying device.

3. The inkjet printer of claim 1, wherein the remaining quantity detector is a photosensor for detecting a position of the damper membrane or a pressure sensor for detecting a pressure of the ink flowing out from the intermediate tank.

4. The inkjet printer of claim 1, wherein the recording head comprises a heating device to heat the ink which is a liquid having a viscosity of 10 to 500 mPa·s at a temperature of 30° C., to 30-150° C., and the ink is jetted such that one dot of the droplets is 2-20 pl.

5. The inkjet printer of claim 1, wherein the ink is a high-viscosity cationic polymerization ultraviolet-light curable ink.

6. The inkjet printer of claim 1, wherein the recording medium does not absorb the ink.

7. The inkjet printer of claim 1, wherein a negative pressure state is maintained in the intermediate tank by a repulsive force of the elastic member.

8. The inkjet printer of claim 1, wherein the controller controls so that a prescribed range of a negative pressure state is maintained in the intermediate tank.

9. The inkjet printer of claim 1, wherein the controller controls so that a prescribed range of a position of the damper membrane is maintained.

10. The inkjet printer of claim 1, further comprising:

a light irradiating device to irradiate light onto the ink deposited on the recording medium downstream in a conveying direction of the recording medium than the recording head, wherein the ink is a photo-curing type ink which is photo-cured by an irradiation of the light.

11. The inkjet printer of claim 10, wherein the ink is an ultraviolet light curing type ink which is cured by irradiation of ultraviolet light, and at least a part of the light irradiated from the light irradiating device is ultraviolet light.

12. The inkjet printer of claim 1, wherein the liquid feeding pump is a metering pump.

13. The inkjet printer of claim 12, wherein the metering pump is a plunger pump.

* * * * *